350-331 SR
10/9/79 XR 4,170,771

United States Patent [19] [11] 4,170,771
Bly [45] Oct. 9, 1979

[54] ORTHOGONAL ACTIVE-PASSIVE ARRAY PAIR MATRIX DISPLAY

[75] Inventor: Vincent T. Bly, Alexandria, Va.

[73] Assignee: The United States of America as represented by the Secretary of the Army, Washington, D.C.

[21] Appl. No.: 890,896

[22] Filed: Mar. 28, 1978

[51] Int. Cl.[2] ..... H05B 33/00
[52] U.S. Cl. ..... 340/781; 340/166 EL; 340/784; 340/752; 350/331; 350/345; 358/241
[58] Field of Search ..... 340/324 R, 324 M, 781, 340/783, 784; 350/331, 332, 333, 335, 345, 349, 356

[56] References Cited

U.S. PATENT DOCUMENTS

| | | | |
|---|---|---|---|
| 3,718,382 | 2/1973 | Wysocki et al. | 340/324 M |
| 3,811,751 | 5/1974 | Myer | 350/345 |
| 3,869,195 | 3/1975 | Aldrich et al. | 350/345 |
| 3,882,490 | 5/1975 | Tashiro et al. | 350/331 |
| 3,950,078 | 4/1976 | Zatsky | 350/345 |
| 4,054,368 | 10/1977 | Krueger et al. | 350/345 |

*Primary Examiner*—David L. Trafton
*Attorney, Agent, or Firm*—Nathan Edelberg; Milton W. Lee; Max L. Harwell

[57] ABSTRACT

An orthogonal active-passive array pair matrix display comprised of two orthogonal one-dimensional array displays. The output from an active display, which is formed of parallel individually controlled light emitting lines, is seen through a passive display, which is formed of parallel individually controlled light controlling lines. The passive light controlling lines are orthogonal to the active light emitting lines.

10 Claims, 5 Drawing Figures

ORTHOGONAL ACTIVE-PASSIVE ARRAY PAIR MATRIX DISPLAY

The invention described herein may be manufactured, used and licensed by the U.S. Government for governmental purposes without the payment of any royalties thereon.

BACKGROUND OF THE INVENTION

The field of the present invention is that of an orthogonal active-passive array pair matrix display that is comprised of two critical working components, namely separate active and passive arrays that are one-dimensional array displays. The outputs from the parallel active display lines are observed through the orthogonal lines of the passive display. The outputs of the active lines and the transmissions of the passive lines are individually controlled by associated electronics. Many active-passive array display pairs may be produced from known phenemena. Many scan or address schemes are possible.

SUMMARY OF THE INVENTION

This invention is easily understood by describing the two working components as being two separate one-dimensional array displays, one active or light emitting and the other passive or light controlling. The light emitting array is seen-through an optical coupling means-by the light controlling array. The two arrays are positioned and controlled such that a video or other type scan mode is seen. A detail description follows but the critical concept revolves around the orthogonal active and passive one-dimensional array displays which may be based on many phenomena.

DETAILED DESCRIPTION OF THE INVENTION

Figure 1:
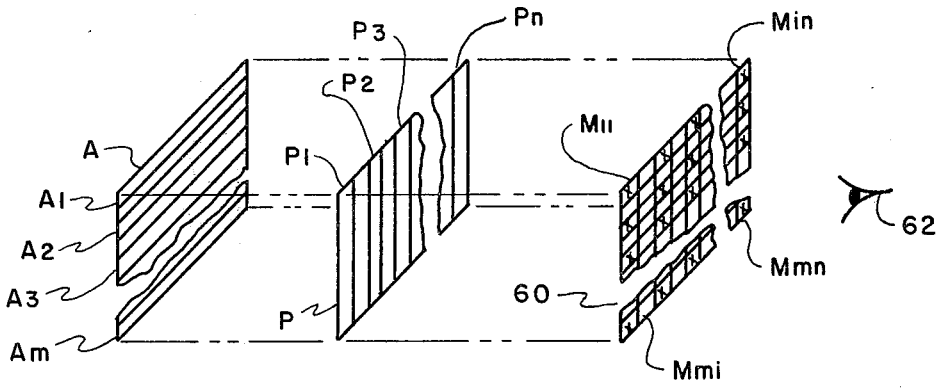
FIG. 1 illustrates a broad concept of the active and passing orthogonal array of the present invention.

FIG. 1 shows the array and matrix geometries of the orthogonal active-passive array pair matrix display. The M X N matrix, shown as Am and Pn, as viewed by an observer is formed by viewing the M-element active light emitting one-dimensional array display A through the N-element passive light controlling one-dimensional array display P. The active display A has M parallel lines, designated as A1, A2, A3 . . . Am, which may be some controllable light emitting phenomena such as an electroluminescence array or light emitting diodes with one-dimensional, end-fed light-guides. Each line may be individually addressed by line-at-a-time. The passive display P has N parallel lines, designated as P1, P2, P3 . . . Pn, which uses some controllable light transmitting phenomena. The active display and passive display may be mounted on opposite sides of the same transparent dielectric optical coupling means, such as a fiber optic plate, a thin glass layer, or a relay lens could be used. The light controllers could be liquid crystals, suspended dipoles or other electro-optic variable transmission optical elements.

Many types of active and passive display phenomena and media can be used to form the orthogonal active-passive array pairs. Many scan or address schemes can be utilized with these orthogonal active-passive array pairs. Possible scan modes for addressing the active and passive lines may be random access, pixel-at-a-time and line-at-a-time, etc.

PREFERRED SCAN MODE

Figure 2:
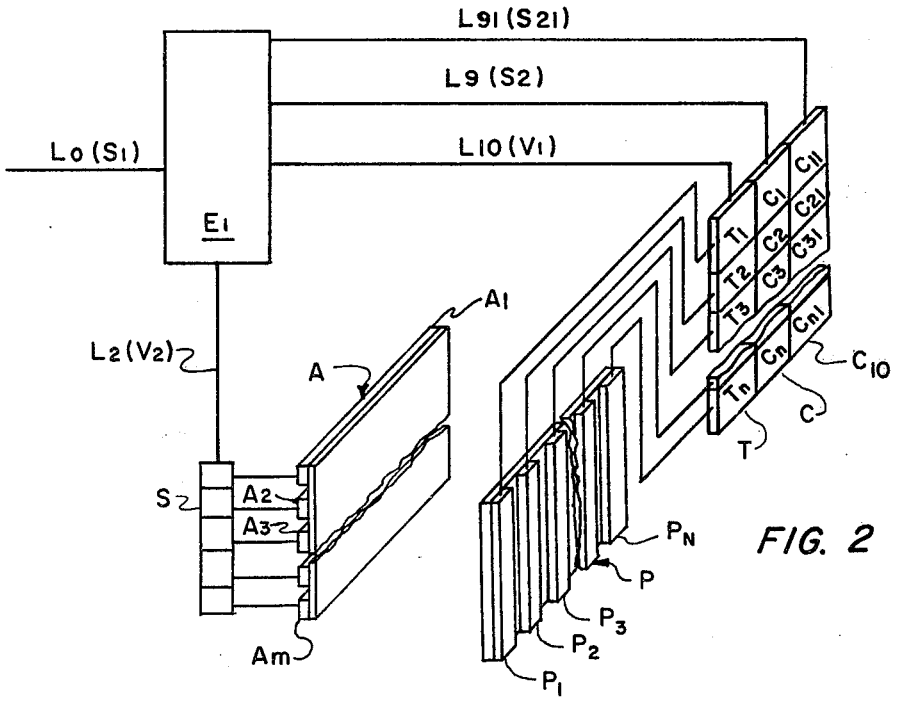
FIG. 2 further illustrares the present invention having control electronics attached to the active and passive array pairs.

A preferred scan mode is presented that yields an efficient information display for which only line rate electronics and materials are needed. FIG. 2 is a schematic diagram shwoing the control electronics for this mode. A normal video signal S1 is received by the control electronics E1 over the signal input lead Lo. Modified line signals S2 and S21, which have been suitably modified by the control electronics E1 to conform to system requirements, are delivered respectively over Leads L9 and L91 to first and second N-element serial-to-parallel converter arrays C and C10. At any instant one of the first or second converter arrays C or C10 is performing N-element serial-to-parallel conversions, while the other converter array C or C10 is parallel dumped onto the gates of the compatible transistor array T. In the next succeeding line scan the roles of the two converter arrays will be reversed. As an example of one sequence, converter array C divides signal S2 representing one scan line into a plurality of N parts that are serial-to-parallel stored in the N converter elements, represented as C1, C2, C3 . . . Cn. At the same instant the N converter elements in the second converter array C10 are parallel dumped onto the gates of a plurality of N transistors, represented as T1, T2, T3 . . . Tn, in the compatible transistor array T. The elements of C10 are represented as C11, C21, C31 . . . Cn1. The compatible transistor array T proportionally gates enabling voltages controlling signal V1, which is obtained from the control electronics E1 over Lead L10 onto all of the N parallel lines P1, P2, P3 . . . Pn of the N-element passive display P. Therefore, one video line of the active display has been represented by the simultaneous transmittances of all of the parallel lines in the passive display P. When this has been accomplished, the corresponding line of the active array A is activated by enabling voltages from signal V2 from control electronics E1 along lead L2 to switching electronics S and therefore one video line is observed. Sequential video lines are represented by the passive display in the same manner and sequential active array lines A1, A2, A3 . . . Am are activated to effect a video type scan.

DESCRIPTION OF ONE EMBODIMENT

Figure 3:
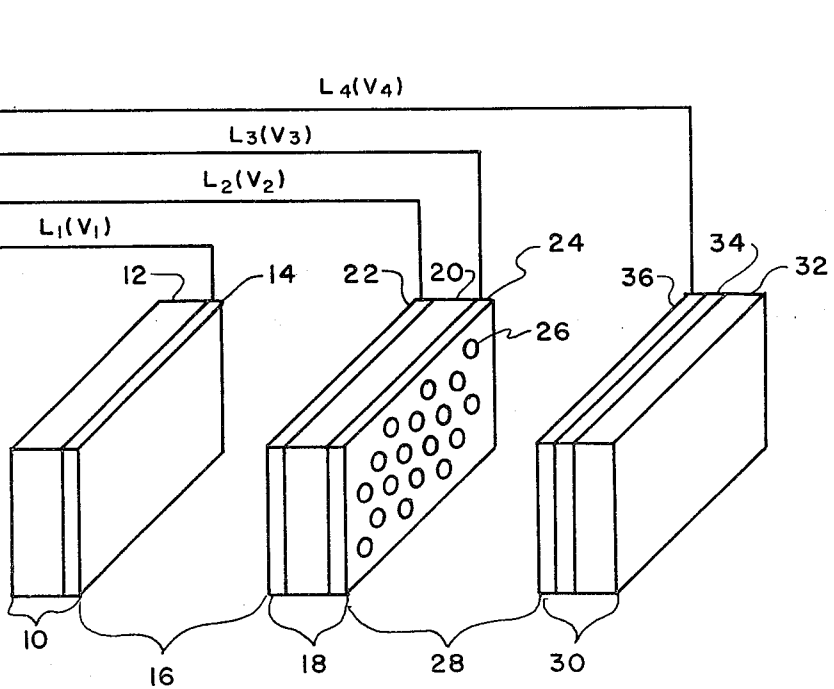
FIG. 3 shows a schematic of the working elements of a microchannel plate wafer tube.
Figure 5:
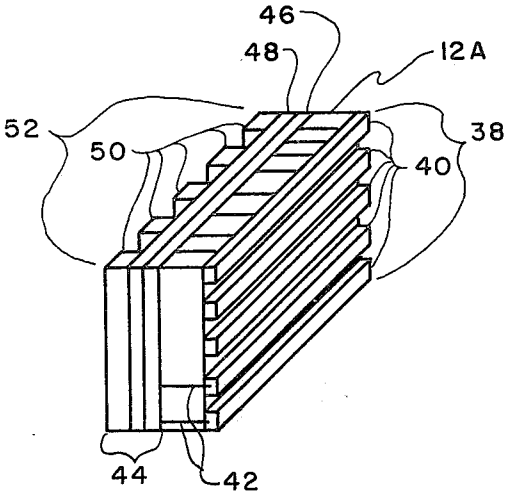
FIG. 5 illustrates one specific embodiment of the present invention that may be used in the wafer tube.
Figure 4:
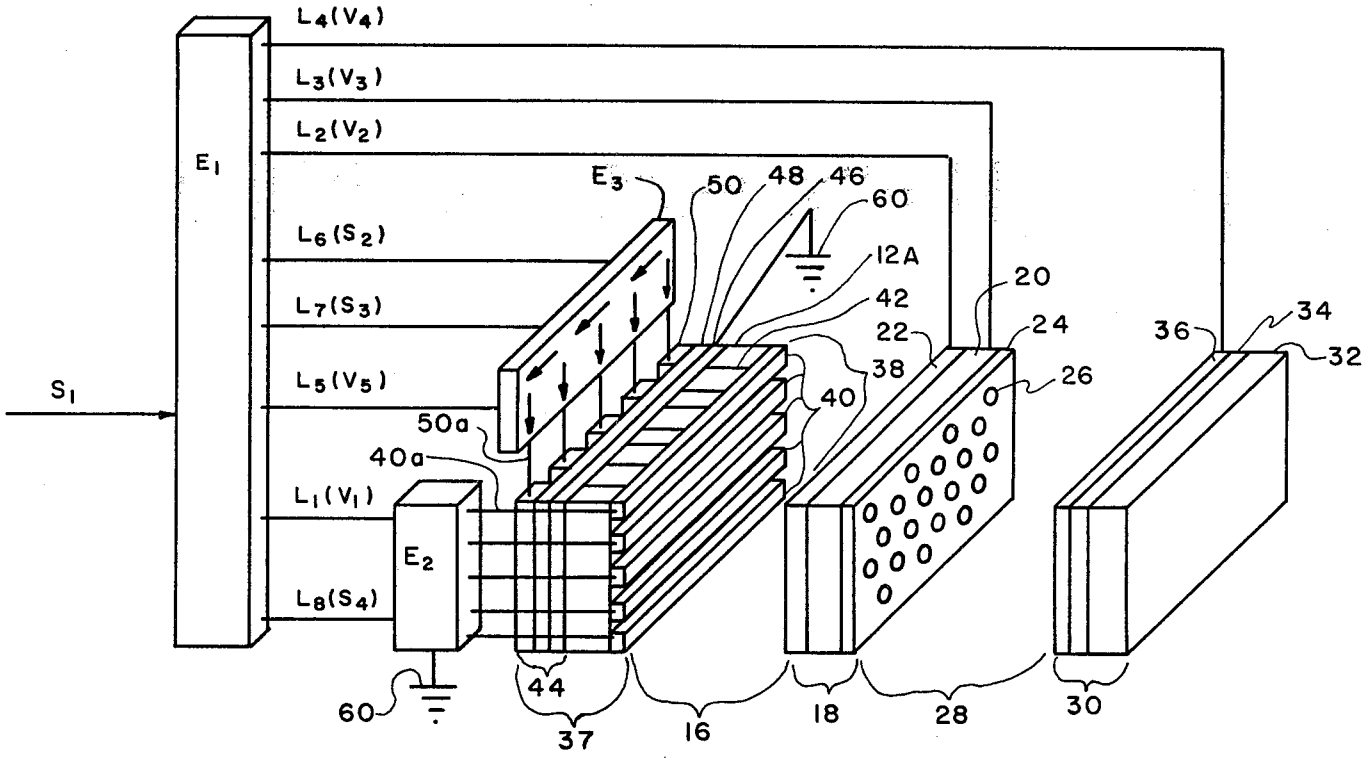
FIG. 4 shows a revised version of the wafer tube of FIG. 3 wherein the present invention is used as the input of the wafer tube.

FIGS. 3, 4, and 5 represent one embodiment where the present orthogonal active-passive array pair matrix may be used, but its use is not limited thereto. This specific embodiment uses an electroluminescent array as the active array, and a microchannel plate (MCP) wafer tube with a stripped cathode array as the controlling array. This display uses components of standard MCP image intensifier wafer tubes except for the input faceplate assembly, which is comprised of the present invention. FIG. 3 is a schematic of the working elements of a typical MCP wafer tube. The three major components are (1) the input faceplate assembly comprised of the input faceplate 12 and photocathode 14, (2) the MCP assembly 18 comprised of the MCP 20 having input and output electrodes 22 and 24 respectively, and (3) the output assembly 30 comprised of outer faceplate 32, phosphor screen 34 and phosphor electrode 36. A vacuum envelope (not shown) is sealed to the input and output faceplates 12 and 32 respectively. Leads L1, L2, L3 and L4 are connected respectively to the cathode 14 and electrodes 22, 24, and 36 via vacuum seal feed-throughs (not shown) to the electronics and power supplies package 8 which supplies the operational voltages V1, V2, V3 and V4 to the wafer tube. The vacuum envelope and vacuum seal feed-throughs are needed to hold a vacuum within the MCP wafer tube. Space 16 is the cathode MCP-proximity space and space 18 is the MCP-phosphor proximity space. The input faceplate assembly 10 of FIG. 3 may be replaced with the present orthogonal active-passive array pair matrix, shown isolated in FIG. 5 or included in the MCP wafer tube as shown in FIG. 4.

Look more closely at FIG. 5 for an explanation of the present orthogonal active-passive array pair matrix. The matrix is shown mounted on some optical coupling means 12A that is transparent, along with being a good dielectric since the active display and passive display on either side thereof require electrical isolation from each other. The optical coupling means 12A may be fiber optic for the small diameters wafers of say 1–3 inches, but for larger sizes could use flat clear layers of either light glass or plastic that is trnsparent and a good dielectric. Another otpical coupling means could be a relay lens between the active display and the passive display that images the active display onto the passive display. This optical coupling means 12A is shown as made of fiber optics having vacuum feed-throughs 42 therethrough between the M-element active, light emitting one-dimensional array display stripes 50 of active electrode array 52 and N-element passive light controlling one-dimensional array display stripes 40 of passive electrode array 38. The passive electrode array 38 may be deposited directly on the optical coupling means 12A. However, the active electrode array 52, which is comprised of a portion of the more broadly and previously mentioned controllable light emitting phenomen or active display A, such as an electroluminescent array designated as 44 is comprised of a transparent electrode 46 that is contiguous with the fiber optic faceplate 12A, an electroluminescent layer 48 that is contiguous with the transparent electrode 46, and the active electrode array 52 that is laid upon electroluminescent layer 48. Layer 48 may be made of one of many phosphors, such as P-25 phosphor, in a single sheet with a common electrode on one side and striped electrode on the other side. Another active linear array could be a linear array of light emitting diodes (LEDs) on a flat clear dielectric layer.

FIG. 4 illustrares in block diagram the connection of the orthogonal active-passive array pair matrix to electronics associated therewith for the specific embodiment as noted. First, the control electronics E1 receives a video-type input signal S1 and converts this signal into modified video line signals S2 as required by the electroluminescent array electronics E3. Signal S2 is delivered over the lead L6. A timing signal, designated as S3, and an AC power signal, designated V5, are also delivered over leads L7 and L5 respectively to the electroluminescent array electronics E3. Electronics E3 divides the incoming video-type signal S2 on a line-at-a-time basis into parallel components and then dumps these signals onto gates of an M-element transistor array which gates the AC power signal to the M electroluminescent electrode stripes 50. In this parallel dumped line-at-a-time mode, video lines are represented by the outputs from stripes 50. The control electronics E1 also supplies the usual tube operating voltages as discussed above except that the cathode voltage V1 on lead L1 is now delivered to the cathode array electronics, represented as E2, and a timing signal S4 is delivered over lead L8. The cathode array electronics E2 sequentially gates on the cathode stripes 40 one-at-a-time. Typical operating voltages would be V1=20 volts, V2=ground, V3=700 volts, V4=5700 volts, V5=100 volts AC peak-to-peak.

It should be understood that the foregoing disclosure relates to a broad invention and a specific scan mode of the broad invention. Numerous phenemonena and media may be utilized to form the orthogonal active and passive displays and many different scan schemes and associated drive electronics may be used with the orthogonal active-passive array pairs. Numerous modifications or alterations may be made therein without departing from the spirit and the scope of the invention as set forth in the appended claims.

I claim:

1. An orthogonal active-passive array pair display comprising:

a transparent dielectric optical coupling means;

a one-dimensional active display having parallel light emitting lines on an input side of said transparent dielectric optical coupling means with the output emissions of each of said parallel light emitting lines being separately controllable by enabling voltages applied thereto;

a one-dimensional passive display having parallel light controlling lines on an output side of said transparent dielectric optical coupling means that are orthogonal to said parallel light emitting lines with the transmission of each of said parallel light controlling lines being separately controllable by enabling voltages applied thereto in which the output emissions of said active display are seen by said passive display through said transparent dielectric optical coupling means; and a control electronic means for accepting video-type input signals and for modifying said video-type input signals therein for separately controlling the enabling voltages applied to said active display and to said passive display by providing a preferred scan mode of the enabling voltages applied to individual lines of said parallel light emitting lines and said parallel light controlling lines in which each video line is applied to one individual line of said parallel light emitting lines of said active display and to all of said parallel light controlling lines of said passive display through first and second serial-to-parallel converter arrays that simultaneously control all of said passive display lines by performing serial-to-parallel conversions on selected individual line scan video signals into a plurality of parallel converter elements that are serial-to-parallel stored in one of said first or second serial-to-parallel arrays while the other of said first or second serial-to-parallel converter arrays simultaneously parallel dump other selected individual line scan video signals upon which serial-to-parallel conversions had been performed on a previous video scan line wherein parallel dumping is into the gates of a plurality of parallel transistors of a compatible transistor array that gate enabling voltages to said passive display parallel light controlling lines and alternately repeating the serial-to-parallel conversions and parallel dumping between said first and second serial-to-parallel converter arrays of selected individual line scan video signals in order to display information contained in said video-type input signals.

2. A display as set forth in claim 1 wherein said optical coupling means is a fiber optic faceplate.

3. A display as set forth in claim 1 wherein said optical coupling means is a flat clear dielectric layer.

4. A display as set forth in claim 1 wherein said optical coupling means is relay lens that images the active display onto the passive display.

5. A display as set forth in claim 1 wherein said active display parallel light emitting lines are made of electroluminescent material.

6. A display as set forth in claim 1 wherein said active display parallel light emitting lines are an array of light emitting diodes with one-dimensional end-fed light-guides.

7. A display as set forth in claim 1 wherein said passive display parallel light controlling lines are electro-optic variable transmission optical filters.

8. A display as set forth in claim 1 wherein said passive display parallel light controlling lines are liquid crystals.

9. A display as set forth in claim 1 wherein said preferred scan mode is by random access.

10. A display as set forth in claim 1 wherein said preferred scan mode is by line-at-a-time.

* * * * *